US006284422B1

(12) United States Patent
Nagahama et al.

(10) Patent No.: US 6,284,422 B1
(45) Date of Patent: Sep. 4, 2001

(54) TONER FOR DEVELOPING ELECTROSTATIC LATENT IMAGES AND IMAGE-FORMING APPARATUS

(75) Inventors: Hitoshi Nagahama, Uji; Toshihiko Murakami; Katsuaki Sumida, both of Kashiba; Junichi Saito, Nara, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/557,299

(22) Filed: Apr. 25, 2000

(30) Foreign Application Priority Data

May 14, 1999 (JP) ..... 11-134567
Oct. 28, 1999 (JP) ..... 11-307358

(51) Int. Cl.[7] ..... G03G 9/08
(52) U.S. Cl. ..... 430/108.23; 430/106
(58) Field of Search ..... 430/106, 110

(56) References Cited

U.S. PATENT DOCUMENTS 4,562,136 * 12/1985 Inoue et al. ..... 430/110
4,563,409 * 1/1986 Suzuki et al. ..... 430/110
6,156,469 * 12/2000 Sato ..... 430/110

FOREIGN PATENT DOCUMENTS 0 627 688 A1 12/1994 (EP) .
5-072805 3/1993 (JP) .

OTHER PUBLICATIONS

Patent Abstracts of Japan, vol. 1998, No. 05, Apr. 30, 1998 & JP 10 010789 A (TORAY IND INC.), Jan. 16, 1998.

Database WPI, Section CH, Week 199438, Derwent Publications Ltd., London, GB; Class A89, AN 1994–308118 XP002144678 & JP 06 236068 A (HITACHI METALS LTD), Aug. 23, 1994.

* cited by examiner

*Primary Examiner*—John Goodrow
(74) *Attorney, Agent, or Firm*—Nixon & Vanderhye

(57) ABSTRACT

A toner for developing electrostatic latent images comprises a polyester resin and an electric charge controlling agent containing a chromium complex compound, wherein the polyester resin has an acid value Z of 15 to 30 ($15<Z\leqq 30$) mgKOH/g and a hydroxyl value Y of 4 to 17 ($4\leqq Y\leqq 17$) mgKOH/g.

17 Claims, No Drawings

TONER FOR DEVELOPING ELECTROSTATIC LATENT IMAGES AND IMAGE-FORMING APPARATUS

CROSS-REFERENCES TO RELATED APPLICATIONS

This application is related to Japanese Patent Applications Nos. HEI 11(1999)-134567 and HEI 11(1999)-307358, filed on May 14, 1999 and Oct. 28, 1999 whose priorities are claimed under 35 USC §119, the disclosures of which are incorporated by reference in their entirety.

BACKGROUND OF THE INVENTION

1. Field of the Invention

The present invention relates to a toner for developing electrostatic latent images and an image-forming apparatus, more particularly, a toner for developing electrostatic latent images which is used in an image-forming apparatus such as a copying machine and an apparatus for forming images using the toner.

2. Description of Related Art

Highly charge-receptive toners have been proposed (for example, Japanese Unexamined Patent Publication No. HEI 5(1993)-72805) which exhibit a good triboelectrification property and are not liable to form blurs in print and spots in non-printed part, not only in developing apparatuses used by a two-component developing method which is a dry development method but also in developing apparatuses used by a one-component developing method in which toners are not in frequent contact with charge donor materials and in developing apparatus in which charge donor materials have a poor charge donating efficiency.

The toner of the above-mentioned publication is comprised of a polyester resin, a colorant and an electric charge controlling agent. As the polyester resin, used is one having an acid value not greater than 15 mgKOH/g, and as the electric charge controlling agent, used is a chromium complex compound represented by the following formula:

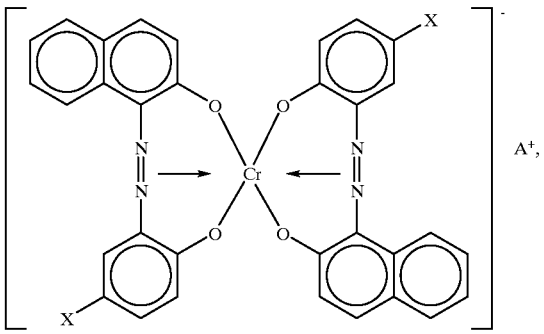

(wherein X is Cl, Br, $SO_2NH_2$, $SO_2CH_3$ or $SO_2C_2H_5$, and $A^+$ is a $C_{8-16}$ straight-chain alkylammonium or a $C_{8-16}$ branched alkylammonium in which the alkyl moiety is optionally interrupted by an oxygen atom.

The reason why the acid value of the polyester resin in the above toner is 15 mgKOH/g or less is that, if the acid value is over 15 mgKOH/g, free carboxyl groups contained in the polyester resin, which have electron receptivity, improve negative electrification of the toner itself, while chelated rings of a chromium complex compound become liable to decompose. Therefore, the chromium complex compound is prevented from displaying its function as an electric charge controlling agent sufficiently. Especially, if the acid value exceeds 25 mgKOH/g, time constant until the charged triboelectrified amount of the toner reaches its saturation becomes large, and therefore, sufficient triboelectrification is difficult to obtain in the developing apparatus.

On the other hand, if the acid value is 10 mgKOH/g or below, the chromium complex compound is not decomposed at chelate rings due to the effect of carboxyl groups, which brings extremely good electrification characteristics by synergism with readiness to negative electrification that the polyester resin has.

However, if the acid value of the polyester resin is 15 mgKOH/g or below, excellent negative electrification and offset-resistant properties intrinsic to the polyester resin are restricted. A problem lies in that the polyester resin cannot exhibit its excellent properties fully.

SUMMARY OF THE INVENTION

Accordingly, the present invention provides a toner for developing electrostatic latent images comprising a polyester resin and an electric charge controlling agent containing a chromium complex compound, wherein the polyester resin has an acid value Z of 15 to 30 mgKOH/g ($15<Z\leqq 30$) and a hydroxyl value Y of 4 to 17 mgKOH/g ($4\leqq Y\leqq 17$).

In other words, the inventors of the present invention have made intensive studies for a toner for developing electrostatic latent images which has sufficient electrification characteristics and does not bring about problems such as blushing, toner scattering and the like while maintaining the property of being negatively electrified and the property of exhibiting offset-resistance at fixation intrinsic to the polyester resin. As a result, we have found that the acid value and hydroxyl value of the polyester resin contained in the toner for developing electrostatic latent images have a close relation with the electrification characteristics, especially in a high-temperature high-humidity environment, that the electrification characteristics are stabilized by including a positive charge controlling agent in the toner, and that admixture of a specific fluidizing agent on the surface of the toner provides still better effect (prevention of reduction in image density when copying a low-density manuscript), finally to achieve the present invention.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

The toner for developing electrostatic latent images of the present invention mainly contains a polyester resin and an electric charge controlling agent comprised of a chromium complex compound.

The polyester resin used in the toner of the present invention is a polymer combined by ester bonding through polycondensation of a polybasic acid and a polyhydric alcohol. The polymer may be saturated or unsaturated. The kind of the polyester resin is not particularly limited, and examples thereof include various polymers such as unsaturated polyester resins, alkyd resins, polyethylene terephthalates, polybutylene terephthalates, polyarylates and the like, among which unsaturated polyesters are preferred.

The kind of the polybasic acid forming the polyester resin is not particularly limited, and examples thereof include maleic acid, maleic anhydride, fumaric acid, citraconic acid, citraconic anhydride, itaconic acid, mesaconic acid, phthalic acid, phthalic anhydride, isophthalic acid, terephthalic acid, succinic acid, succinic anhydride, adipic acid, azelaic acid, sebacic acid, tetrahydrophthalic acid, tetrahydrophthalic anhydride, hexahydrophthalic acid, hexahydrophthalic anhydride, tetrabromophthalic acid, tetrabromophthalic anhydride, tetrachlorophthalic acid, tetrachlorophthalic anhydride, HET (chloroendic) acid, HET anhydride, endomethylene tetrahydrophthalic acid, endomethylene tetrahydrophthalic anhydride, trimellitic acid, trimellitic anhydride, pyromellitic acid, pyromellitic anhydride and the like.

The kind of the polyhydroxy alcohol is not particularly limited, and examples thereof include ethylene glycol, propylene glycol, 1,3-butanediol, 1,4-butanediol, 1,3-butylene glycol, 1,6-hexanediol, 1,5-pentanediol, 1,6-pentanediol, diethylene glycol, dipropylene glycol, neopentyl glycol, triethylene glycol, hydrogenated bisphenol A, polyoxyethylenated bisphenol A, polyoxypropylenated bisphenol A, bisphenol dihydroxypropyl ether, glycol, glycerol and the like.

The polyester polymer may contain one or two or more of the above-mentioned polybasic acids and one or two or more of the above-mentioned polyhydroxy alcohols.

In the present invention, the polyester resin has an acid value Z of 15 to 30 mgKOH/g ($15<Z\leqq 30$)and a hydroxyl value Y of 4 to 17 mgKOH/g ($4\leqq Y\leqq 17$). Here, the acid value means the number of carboxyl residues at the end of the polyester resin, and the hydroxyl value means the number of hydroxyl residues at the end of the polyester resin. The acid value can be raised by increasing the use ratio of the polybasic acid (e.g., trimellitic acid) with respect to a dibasic acid in the polyester resin. The hydroxyl value can be decreased by reducing end groups of the alcoholic component. For example, the acid value can be raised by adding about 1 to 5 % of trimellitic anhydride as well as about 1 to 5% of maleic anhydride. The hydroxyl value can be adjusted within the above-mentioned range by adding the amount of terephthalic acid slightly.

A polyester resin comprised of a polybasic acid having an aromatic ring and a polyhydric alcohol is preferred because of its good blocking resistance. Especially preferred is a polyester resin produced by reacting a polyol with a polycarboxylic acid containing an aromatic tricarboxylic acid or its derivative.

The polyester resin of the present invention is usually obtained by condensation reaction with dehydration or by ester exchange reaction of materials as mentioned above in an organic solvent in the presence of a catalyst. The reaction temperature and reaction time are, for example, 20 to 200° C. and 1 to 24 hours. When the above-mentioned reaction is carried out, an esterifying catalyst or an ester exchange catalyst such as magnesium acetate, zinc acetate, lead acetate, antimony trioxide or the like may be used for the purpose of accelerating the reaction.

In the present invention, for example, the amount of maleic anhydride and trimellitic anhydride may be increased to obtain a polyester resin having a relatively large acid value, thereby to improve the offset-resistant property and also the negative electrification property. Also a polyester resin having a relatively small hydroxyl value may be used, thereby to suppress moisture absorption and improve electrification stability against ambience, that is, the electrification stability can be obtained even in a hot and humid environment.

Preferably the polyester resin of the present invention has a glass transition point (Tg) of 55 to 65° C. and/or a melt index (MI) of 0.1 to 6.0 g/10 minutes. If the above parameters are within these ranges, the polyester resin has an improved blocking resistance and/or an improved offset-resistant property.

The electric charge controlling agent of a chromium complex compound in the present invention is not particularly limited to any kind, but for example, may be mentioned a chromium complex compound represented by the following formula:

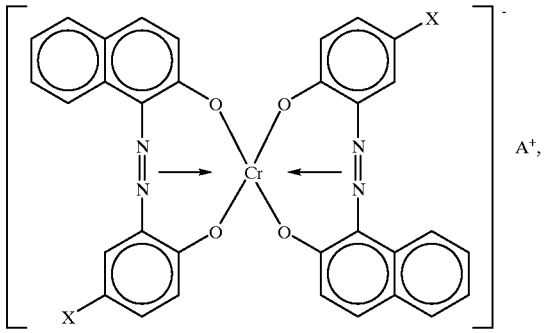

wherein X is Cl, Br, $SO_2NH_2$, $SO_2C_3$ or $SO_2C_2H_5$, and A is a $C_{8-16}$ straight-chain alkylammonium or a $C_{8-16}$ branched alkylammonium in which the alkyl moiety is optionally interrupted by a hetero atom.

Here, as the hetero atom, may be mentioned nitrogen atom, oxygen atom, sulfur atom and the like, among which oxygen atom is preferable.

As the $C_{8-16}$ straight-chain alkylammonium, may be mentioned $^{+}NH_3C_{12}H_{25}$, $^{+}NH_3C_{14}H_{29}$ and the like.

As the $C_{8-16}$ branched alkylammonium optionally interrupted by a hetero atom, may be mentioned $^{+}NH_3C_3H_6OC(C_2H_5)HC_4H_9$, $^{+}NH_3C_3H_6OCH_2C(C_2H_5)HC_4H_9$ and the like.

The toner for developing electrostatic latent images of the present invention preferably contains about 80 to 95 wt %, more preferably about 85 to 90wt %, of the polyester resin and about 0.5 to 5 wt %, more preferably about 1 to 3 wt %, of the chromium complex compound, with respect to the total weight of the toner.

The toner of the present invention may further contain a positive charge controlling agent. As positive charge controlling agents usable here, may be mentioned nigrosine dyes, pyridinium salts, ammonium salts or lake compounds thereof, for example. The positive charge controlling agent is preferably contained in a proportion of about 0.05 to 0.5 wt %, more preferably about 0.1 to 0.3 wt %, with respect to the total weight of the toner.

The toner of the present invention may further contain additives such as a fixing/releasing agent, a colorant, a dispersant, magnetic powder and the like which can usually be used for toners. Also in addition to the polyester resin, other kinds of resins may be used.

As examples of fixing/releasing agents, may be mentioned natural wax such as montan wax; polyolefin wax such as high-pressure polyethylene and polypropylene; silicone wax and fluorine-containing wax.

As examples of colorants, may be mentioned carbon black, magnetic powder, nitro-containing dyes, stilbeneazo dyes, diphenylmethane dyes, triphenylmethane dyes, methine dyes, thiazole dyes, anthraquinone dyes, imidamine dyes, azine dyes, oxazine dyes, thiazine dyes, sulfur dyes, indigoid dyes, phthalocyanine dyes and the like organic dyes and pigments.

As examples of dispersants, may be mentioned metallic soap and polyethylene glycol.

As examples of magnetic powder, may be mentioned metals such as ion, cobalt, nickel, chromium and manganese, alloys thereof, and metal oxides such as chromium dioxide, ferric sesquioxide and ferrite.

As examples of other resins usable here, may be mentioned styrene resin, styrene-acrylic copolymer resin, styrene-acrylonitrile copolymer resin, acrylic resin, styrene-maleic anhydride copolymer resin, styrene-acrylic-maleic anhydride copolymer resin, polyvinyl chloride resin, polyvinyl acetate resin, polyolefin resin, polyurethane resin, urethane modified polyester resin, epoxy resin and the like.

The toner of the present invention may contain particles of a fluidizing agent having a specific surface area within the range of 90 to 240 $m^2/g$ and/or positively electrifiable particles. That is, the toner may carry the fluidizing agent on its surface or the fluidizing agent particles and positively electrifiable particles may be carried on its surface.

As such fluidizing agents, may be mentioned silica fine powder, aluminum oxide fine powder, polyfluoroethylene (trade name: Teflon), zinc stealate, polyvinylidene fluoride, cerium oxide, silicon carbide and the like, among which silica fine powder is particularly preferably. If the fluidizing agent particles have a specific surface area less than 90 $m^2/g$, the amount of air and the fluidizing agent particles existing between the toner particles and toner carriers decreases. Therefore the spacing effect of the fluidizing agent particles is diminished, and with an increased amount of the fluidizing agent particles, aggregation may take place and white spots may be produced. On the other hand, if the fluidizing agent particles have a specific surface area more than 240 $m^2/g$ the spacer effect is improved, but more aggregation may take place with white spots produced.

As fluidizing agent particles, commercially available particles such as Aerosil R976S (specific surface area: 110), Aerosil R974 (specific surface area: 170), Aerosil R812S (specific surface area: 220) (produced by Nippon Aerosil, Japan), Wacker HDK H3004 (specific surface area: 200), Wacker HDK H2000 (specific surface area: 140) (produced by Wacker), TS-530, TS-720 and TG-811 (produced by Cabot) may be used advantageously.

The above-mentioned fluidizing agent particles may preferably be carried in a proportion of about 0.1 to 3.0 wt %, particularly 0.3 to 1.0 wt %, with respect to the total weight of the toner.

In the case where the fluidizing agent particles are used with positively electrifiable particles having the property of being positively electrified, the fluidizing agent particles may preferably be carried in a proportion of about 0.1 to 5.0 wt %, particularly 0.3 to 4.0 wt %, with respect to the total weight of the toner.

If the blend ratio of the fluidizing agent particles is lower than the above-mentioned range, the toner and a developer lose fluidity and thereby ununiformity in solid shading occurs. If the blend ratio of the fluidizing agent particles is higher than the above-mentioned range, white spots appear in solid shading owing to aggregation.

As examples of positively electrifiable particles, may be mentioned inorganic particles of titanium oxide, aluminum oxide; organic particles of polymethylmethacrylate, and the like, among which inorganic particles of titanium oxide are particularly preferable.

As positively electrifiable particles, commercially available agents such as Aerosil T805, Aerosil P25 (produced by Nippon Aerosil), STT-30A (Titanium Kogyo, Japan) may be used advantageously.

The above-mentioned positively electrifiable particles may preferably be carried in a proportion of about 0.01 to 2.0 wt %, particularly preferably about 0.03 to 1.0 wt %, with respect to the total weight of the toner.

If the blend amount of the positively electrifiable particles is lower than 0.01 wt %, they may not have a sufficient capture effect. If the blend amount of the positively electrifiable particles is higher than 2.0 wt %, they may impede the fluidizing effect of the fluidizing agent particles.

In the present invention, by admixing the fluidizing agent particles of a specific surface area (e.g., silica of a specific surface area of 90 to 240 $m^2/g$), a good effect is obtained even in toner low-consumption printing. Also the admixture of the positively electrifiable particles together with the fluidizing agent particles is more preferable because the occurrence of white spots due to aggregation of the fluidizing agent particles can be suppressed.

Generally, in normal copying (continuous copying at a 6% character concentration (density)), a toner in a developing vessel is consumed before charged up and also fluidizing agent particles on the surface of the toner are consumed before buried. Than the next toner is supplied. Accordingly, the toner is replaced appropriately, and a stable electrification amount can be maintained while the fluidity of a developer is not decreased. Thus the density of images is maintained and ununiformity in solid shading does not occur.

On the other hand, in toner low-consumption printing (continuous copying at a 1% character concentration), since the toner in the developing apparatus is replaced less often, more of the toner is over-agitated and the charging-up of the toner is accelerated. At the same time, the fluidizing agent particles originally admixed and carried on the surface of the toner are buried into the surface of the toner when over-agitated, which leads to a decline in the fluidity of the developer and consequently a decline in the supply of the toner to an electrostatic latent image on a photo conductor. That in turn cause increase of the highly charged toner. A synergetic effect with the decline in the fluidity of the developer causes problems such as a decline in the image density and ununiformity in solid shading.

The following are considered to be reasons why the fluidizing agent particles of the present invention exhibits a good effect within the above-mentioned specific surface area range:

1. The particles act as spacers between the toner particles and between the developer particles (toner and carrier) because of their fluidity.
2. As regards the spacer effect, the diameter of the particles plays an important role and it matters greatly how many contact points can be decreased. That is, how much air can be introduced. Therefore, the specific surface area of the fluidizing agent particles is important because of their large/small of a surface energy.

It is considered preferable that the fluidizing agent particles are almost in a primary particles state for exhibiting a spacer function.

In addition, the addition of the positively electrifiable particles to the fluidizing agent particles is considered to suppress the generation of white spots due to aggregation of the fluidizing agent particles because aggregated negatively electrifiable particles and positively electrifiable particles, being charged, are captured by the toner or on the surface of the carrier.

The toner of the present invention may be produced by a known method, for example, by melting and kneading materials at a temperature of about 70 to 180° C. using paratus capable of heating and mixing such as a twin screw kneader or an air-current mixer, e.g., a Henschel mixer, a super mixer and a mechanomill, solidifying the resulting kneaded product by cooling and grinding the solidified product by a grinder such as a jet mill. Grinding is preferably so carried out that the toner particles is about 5 to 25 μm, more preferably, about 7 to 15 μm, in diameter.

The image forming apparatuses of the present invention include all kinds of apparatuses for forming images usually with use of toners, i.e., copying machines, printers, facsimile machines and the like using electronic photography, electrostatic recording, magnetic recording and the like.

The toner for developing electrostatic latent images of the present invention is now described in further detail by way of example.

EXAMPLE 1

100 parts by weight of polyester resin 1 (acid value: 25, hydroxyl value: 11, produced by Sanyo Kasei Kogyo, Japan);

1.5 parts by weight of a negative charge controller (Aizen Spilon Black TRH, produced by Hodogaya Kagaku Kogyo, Japan);

5 parts by weight of carbon black as a colorant (MA-77 produced by Mitsubishi Kagaku, Japan);

2 part by weight of polypropylene as a fixing and releasing agent (Biscol 550P produced by Sanyo Kasei Kogyo).

The above-mentioned materials were mixed, melted and kneaded by a twin-screw extruder, cooled and ground to obtain a toner having a particle diameter of 8 μm.

To the obtained toner, added were 0.5 parts by weight of silica (R972, Nippon Aerosil) as fluidizing agent particles to obtain a toner of Example 1.

EXAMPLE 2

A toner of Example 2 was obtained in the same manner as in Example 1 except that 100 parts by weight of polyester resin 2 (acid value: 20, hydroxyl value: 17, produced by Sanyo Kasei Kogyo) were used instead of polyester resin 1.

EXAMPLE 3

A toner of Example 3 was obtained in the same manner as in Example 1 except that 100 parts by weight of polyester resin 3 (acid value: 15, hydroxyl value: 4, produced by Sanyo Kasei Kogyo) were used instead of polyester resin 1.

COMPARATIVE EXAMPLE 1

A toner of Comparative Example 1 was obtained in the same manner as in Example 1 except that 100 parts by weight of polyester resin 4 (acid value: 32, hydroxyl value: 18, produced by Sanyo Kasei Kogyo) were used instead of polyester resin 1.

COMPARATIVE EXAMPLE 2

A toner of Comparative Example 2 was obtained in the same manner as in Example 1 except that 100 parts by weight of polyester resin 5 (acid value: 10, hydroxyl value: 13, produced by Sanyo Kasei Kogyo) were used instead of polyester resin 1.

COMPARATIVE EXAMPLE 3

A toner of Comparative Example 3 was obtained in the same manner as in Example 1 except that 100 parts by weight of polyester resin 6 (acid value: 20, hydroxyl value: 3, produced by Sanyo Kasei Kogyo) were used instead of polyester resin 1.

EXAMPLE 4

100 parts by weight of polyester resin 1 (acid value: 25, hydroxyl value: 11, produced by Sanyo Kasei Kogyo);

1.5 parts by weight of a negative charge controller (Aizen Spilon Black TRH, produced by Hodogaya Kagaku Kogyo);

0.2 parts by weight of a positive charge controller (Bontron N09 produced by Orient Kagaku, Japan);

5 parts by weight of carbon black as a colorant (MA-77 produced by Mitsubishi Kagaku);

2 part by weight of polypropylene as a fixing and releasing agent (Biscol 550P produced by Sanyo Kasei Kogyo).

The above-mentioned materials were mixed, melted and kneaded by a twin-screw extruder, cooled and ground to obtain a toner having a particle diameter of 8 μm.

To the obtained toner, added were 0.5 parts by weight of silica (R972, Nippon Aerosil) as fluidizing agent particles to obtain a toner of Example 4.

EXAMPLE 5

A toner of Example 5 was obtained in the same manner as in Example 4 except that 100 parts by weight of polyester resin 2 (acid value: 20, hydroxyl value: 17, produced by Sanyo Kasei Kogyo) and 0.2 parts by weight of a positive charge controller (Bontron N04 produced by Orient Kagaku) were used instead of polyester resin 1 and Bontron N09.

EXAMPLE 6

A toner of Example 6 was obtained in the same manner as in Example 4 except that 100 parts by weight of polyester resin 3 (acid value: 15, hydroxyl value: 4, produced by Sanyo Kasei Kogyo) and 0.2 parts by weight of a positive charge controller (Bontron P51 produced by Orient Kagaku) were used instead of polyester resin 1 and Bontron N09.

COMPARATIVE EXAMPLE 4

A toner of Comparative Example 4 was obtained in the same manner as in Example 4 except that 100 parts by weight of polyester resin 4 (acid value: 3, hydroxyl value: 18, produced by Sanyo Kasei Kogyo) was used instead of polyester resin 1.

COMPARATIVE EXAMPLE 5

A toner of Comparative Example 5 was obtained in the same manner as in Example 4 except that 100 parts by weight of polyester resin 5 (acid value: 10, hydroxyl value: 13, produced by Sanyo Kasei Kogyo) and 0.2 parts by weight of a positive charge controller (Bontron N04 produced by Orient Kagaku) were used instead of polyester resin 1 and Bontron N09.

COMPARATIVE EXAMPLE 6

A toner of Comparative Example 6 was obtained in the same manner as in Example 4 except that 100 parts by weight of polyester resin 6 (acid value: 20, hydroxyl value: 3, produced by Sanyo Kasei Kogyo) and 0.2 parts by weight of a positive charge controller (Bontron P51 produced by Orient Kagaku) were used instead of polyester resin 1 and Bontron N09.

EXAMPLE 7

100 parts by weight of polyester resin 1 (acid value: 25, hydroxyl value: 11, produced by Sanyo Kasei Kogyo);

1.5 parts by weight of a negative charge controller (Aizen Spilon Black TRH, produced by Hodogaya Kagaku Kogyo);

0.2 parts by weight of a positive charge controller (Bontron N09 produced by Orient Kagaku, Japan);

5 parts by weight of carbon black as a colorant (MA-77 produced by Mitsubishi Kagaku);

2 part by weight of polypropylene as a fixing and releasing agent (Biscol 550P produced by Sanyo Kasei Kogyo).

The above-mentioned materials were mixed, melted and kneaded by a twin-screw extruder and ground with cooling to obtain a toner having a particle diameter of 8 $\mu$m. To the obtained toner, added were 0.5 parts by weight of silica (Aerosil R976S, Nippon Aerosil) as fluidizing agent particles to obtain a toner of Example 7.

EXAMPLE 8

A toner of Example 8 was obtained in the same manner as in Example 7 except that 100 parts by weight of polyester resin 2 (acid value: 20, hydroxyl value: 17, produced by Sanyo Kasei Kogyo), 0.2 parts by weight of a positive charge controller (Bontron N04 produced by Orient Kagaku) and 0.5 parts by weight of fluidizing agent particles (Aerosil R974 produced by Nippon Aerosil) were used instead of polyester resin 1, Bontron N09 and Aerosil R976S.

EXAMPLE 9

A toner of Example 9 was obtained in the same manner as in Example 7 except that 100 parts by weight of polyester resin 3 (acid value: 15, hydroxyl value: 4, produced by Sanyo Kasei Kogyo), 0.2 parts by weight of a positive charge controller (Bontron P51 produced by Orient Kagaku) and 0.3 parts by weight of fluidizing agent particles (Aerosil R812S produced by Nippon Aerosil) were used instead of polyester resin 1, Bontron N09 and Aerosil R976S.

EXAMPLE 10

A toner of Example 10 was obtained in the same manner as in Example 7 except that 1.0 parts by weight of fluidizing agent particles (HDK H2000 produced by Wacker) were used instead of Aerosil R976S.

EXAMPLE 11

A toner of Example 11 was obtained in the same manner as in Example 7 except that 0.7 parts by weight of fluidizing agent particles (HDK H3004 produced by Wacker) were used instead of Aerosil R976S.

COMPARATIVE EXAMPLE 7

A toner of Comparative Example 7 was obtained in the same manner as in Example 7 except that 100 parts by weight of polyester resin 4 (acid value: 32, hydroxyl value: 18, produced by Sanyo Kasei Kogyo) and 4.0 parts by weight of fluidizing agent particles (specific surface area: 50 $m^2/g$, Aerosil RX50 produced by Nippon Aerosil) were used instead of polyester resin 1 and Aerosil R976S.

COMPARATIVE EXAMPLE 8

A toner of Comparative Example 8 was obtained in the same manner as in Example 7 except that 1.0 parts by weight of fluidizing agent particles (specific surface area: 80 $m^2/g$, Aerosil MOX80 produced by Nippon Aerosil) were used instead of Aerosil R976S.

COMPARATIVE EXAMPLE 9

A toner of Comparative Example 9 was obtained in the same manner as in Example 7 except that 100 parts by weight of polyester resin 5 (acid value: 10, hydroxyl value: 13, produced by Sanyo Kasei Kogyo), 0.2 parts by weight of a positive charge controller (Bontron N04 produced by Orient Kagaku) and 0.1 parts by weight of fluidizing agent particles (specific surface area: 300 $m^2/g$, Aerosil 300 produced by Nippon Aerosil) were used instead of polyester resin 1, Bontron N09 and Aerosil R976S.

COMPARATIVE EXAMPLE 10

A toner of Comparative Example 10 was obtained in the same manner as in Example 7 except that 100 parts by weight of polyester resin 6 (acid value: 20, hydroxyl value: 3, produced by Sanyo Kasei Kogyo), 0.2 parts by weight of a positive charge controller (Bontron P51 produced by Orient Kagaku) and 0.3 parts by weight of fluidizing agent particles (specific surface area: 260 $m^2/g$, Aerosil R812 produced by Nippon Aerosil) were used instead of polyester resin 1, Bontron N09 and Aerosil R976S.

COMPARATIVE EXAMPLE 11

A toner of Comparative Example 11 was obtained in the same manner as in Example 7 except that 0.05 parts by weight of fluidizing agent particles (Aerosil R976S produced by Nippon Aerosil) were used instead of 0.5 parts by weight.

COMPARATIVE EXAMPLE 12

A toner of Comparative Example 12 was obtained in the same manner as in Example 7 except that 4.0 parts by weight of fluidizing agent particles (HDK 143004 produced by Wacker) were used instead of Aerosil R976S.

EXAMPLE 12

100 parts by weight of polyester resin 1 (acid value: 25, hydroxyl value: 11, produced by Sanyo Kasei Kogyo);

1.5 parts by weight of a negative charge controller (Aizen Spilon Black TRH, produced by Hedogaya Kagaku Kogyo);

0.2 parts by weight of a positive charge controller (Bontron N09 produced by Orient Kagaku);

5 parts by weight of carbon black as a colorant (MA-77 produced by Mitsubishi Kagaku);

2 part by weight of polypropylene as a fixing and releasing agent (Biscol 550P produced by Sanyo Kasei Kogyo).

The above-mentioned materials were mixed, melted and kneaded by a twin-screw extruder, cooled and ground to obtain a toner having a particle diameter of 8 $\mu$m.

To the obtained toner, added were 0.5 parts by weight of silica (Aerosil R976S, Nippon Aerosil) as fluidizing agent particles and 0.2 parts by weight of positively electrifiable particles (Aerosil T805 produced Nippon Aerosil) to obtain a toner of Example 12.

EXAMPLE 13

A toner of Example 13 was obtained in the same manner as in Example 12 except that 100 parts by weight of polyester resin 2 (acid value: 20, hydroxyl value: 17, produced by Sanyo Kasei Kogyo), 0.2 parts by weight of a positive charge controller (Bontron N04 produced by Orient Kagaku), 0.5 parts by weight of fluidizing agent particles (Aerosil R974 produced by Nippon Aerosil) and 0.2 parts by weight of positively electrifiable particles (Aerosil P25 produced by Nippon Aerosil) were used instead of polyester resin 1, Bontron N09, Aerosil R976S and Aerosil T805.

EXAMPLE 14

A toner of Example 14 was obtained in the same manner as in Example 12 except that 100 parts by weight of polyester resin 3 (acid value: 15, hydroxyl value: 4, produced by Sanyo Kasei Kogyo), 0.2 parts by weight of a positive charge controller (Bontron P51 produced by Orient Kagaku), 0.3 parts by weight of fluidizing agent particles (Aerosil R812S produced by Nippon Aerosil) and 0.2 parts by weight of positively electrifiable particles (STT-30A produced by Titanium Kogyo) were used instead of polyester resin 1, Bontron N09, Aerosil R976S and Aerosil T805.

EXAMPLE 15

A toner of Example 15 was obtained in the same manner as in Example 12 except that 4.0 parts by weight of fluidizing agent particles (HDK H3004 produced by Wacker) was used instead of Aerosil R976S.

COMPARATIVE EXAMPLE 13

A toner of Comparative Example 13 was obtained in the same manner as in Example 12 except that 100 parts by weight of polyester resin 4 (acid value: 32, hydroxyl value: 18, produced by Sanyo Kasei Kogyo) and 0.5 parts by weight of fluidizing agent particles (specific surface area: 50 $m^2/g$, Aerosil RX50 produced by Nippon Aerosil) were used instead of polyester resin 1 and Aerosil R976S.

COMPARATIVE EXAMPLE 14

A toner of Comparative Example 14 was obtained in the same manner as in Example 12 except that 1.0 parts by weight of fluidizing agent particles (Aerosil MOX80 produced by Nippon Aerosil) was used instead of Aerosil R976S.

COMPARATIVE EXAMPLE 15

A toner of Comparative Example 15 was obtained in the hsame manner as in Example 12 except that 100 parts by weight of polyester resin 5 (acid value: 10, hydroxyl value: 13, produced by Sanyo Kasei Kogyo), 0.2 parts by weight of a positive charge controller (Bontron N04 produced by Orient Kagaku), 0.1 parts by weight of fluidizing agent particles (specific surface area: 300 $m^2/g$, Aerosil 300 produced by Nippon Aerosil) and 0.2 parts by weight of positively electrifiable particles (STT-30A produced by Titanium Kogyo) were used instead of polyester resin 1, Bontron N09, Aerosil R976S and Aerosil T805.

COMPARATIVE EXAMPLE 16

A toner of Comparative Example 16 was obtained in the same manner as in Example 12 except that 100 parts by weight of polyester resin 6 (acid value: 20, hydroxyl value: 3, produced by Sanyo Kasei Kogyo), 0.2 parts by weight of a positive charge controller (Bontron P51 produced by Orient Kagaku) and 0.3 parts by weight of fluidizing agent particles (specific surface area: 260 $m^2/g$, Aerosil R812 produced by Nippon Aerosil) were used instead of polyester resin 1, Bontron N09 and Aerosil R976S.

TEST EXAMPLES

The toners obtained above in Examples 1 to 15 and Comparative Examples 1 to 16 were evaluated on Q/M (blow-off charge amount), image density, blushing, toner fly, uniformity in solid shading, white spotting in solid shading, etc. as shown in Tables 1 to 4 by use of a digital copying machine AR-405 produced by Sharp Kabushiki Kaisha with conducting actual copying in hot and humid ambience (35° C., 85%). Sheets of 8.5×11 inch were used as copying paper.

(1) Q/M was measured by collecting a developer in a developing device after actual copying of 80,000 sheets (using a 6% manuscript), by use of a blow-off powder charge measuring device TB-200 produced by Toshiba Chemical, Japan.

(2) The image density was measured by use of a PROCESS MEASUREMENTS RD914 produced by Macbeth, through actual copying of 80,000 sheets (using a 6% manuscript), and rated as ○ (good) when it was 1.35 or more and as X (bad) when it was less than 1.35.

(3) The blushing was measured by use of a Color Meter ZE 2000 produced by Nippon Denshoku, Japan, through actual copying of 80,000 sheets (using a 6% manuscript), and rated as ○ when it was 0.70 or less and as X when it was more than 1.35.

(4) The toner fly was observed with the eye, through actual copying of 80,000 sheets (using a 6% manuscript), and rated as ○ when almost no stains were observed and as X when stains were observed.

(5) The uniformity in solid shading was observed with the eye, through actual copying of 20,000 sheets (using a 1% manuscript), and rated as ○ when uniformity was observed (underlying paper was not seen), as Δ when a little ununiformity was observed (part of underlying paper was seen) and as X when ununiformity was observed (underlying paper was seen in places).

(6) The white spotting clue to aggregated silica was observed with the eye, through actual copying of 20,000 sheets (using a 1% manuscript), and rated as ○ when no white spots were observed, as Δ when 1 to five 5 spots were observed and as X when 6 or more white spots.

Also the above-mentioned toners were each evaluated on the offset resistance at fixing. For evaluation, the fixing section of a digital copying machine AR-405 produced by Sharp Kabushiki Kaisha was modified to be variable in temperature. The toners were rated as ○ when offset occurred at temperatures of 140° C. or below on a lower temperature side and at temperatures of 200° C. on a higher temperature side and as X in other cases. Sheets of 8.5×11 inch were used as copying paper.

The results of evaluation are shown in Tables 1 to 4.

TABLE 1

| | Acid value/ | Low Toner Consumption Copying (Low Printing Mode) | | | | Offset Resistance | |
|---|---|---|---|---|---|---|---|
| | Hydroxyl value (mgKOH/g) | Image Density With Rating | Blushing with Rating | Toner Fly with the eye | Q/M (μc/g) | at Fixation Offset Occurrence Lower Temp/Higher Temp | General Evaluation |
| Example 1 | 25/11 | 1.40–1.45 ○ | 0.30–0.60 ○ | ○ | 22–27 | 130° C./230° C. ○ | ○ |
| Example 2 | 20/17 | 1.38–1.43 | 0.25–0.45 | ○ | 27–32 | 135° C./225° C. | ○ |

TABLE 1-continued

| | Acid value/ Hydroxyl value (mgKOH/g) | Low Toner Consumption Copying (Low Printing Mode) Image Density With Rating | Blushing with Rating | Toner Fly with the eye | Q/M (μc/g) | Offset Resistance at Fixation Offset Occurrence Lower Temp/Higher Temp | General Evaluation |
|---|---|---|---|---|---|---|---|
| Example 3 | 15/4 | ○<br>1.35–1.40<br>○ | ○<br>0.10–0.40<br>○ | ○ | 34–39 | ○<br>140° C./220° C.<br>○ | ○ |
| Comparative Example 1 | 32/18 | 1.45–1.50<br>○ | 0.70–1.00<br>X | X | 17–22 | 125° C./240° C.<br>○ | X |
| Comparative Example 2 | 10/13 | 1.20–1.30<br>X | 0.10–0.40<br>○ | ○ | 37–42 | 145° C./215° C.<br>○ | X |
| Comparative Example 3 | 20/3 | 1.25–1.35<br>X | 0.10–0.30<br>○ | ○ | 32–37 | 135° C./225° C.<br>○ | X |

TABLE 2

| | Acid value/ Hydroxyl value (mgKOH/g) | Charge Controller Negative/ Positive | Low Toner Consumption Copying (Low Printing Mode) Image Density with Rating | Uniformity in solid shading with the eye | Toner Fly with the eye | Q/M (μc/g) | Offset Resistance at Fixation Offset Occurrence Lower Temp/Higher Temp | General Evaluation |
|---|---|---|---|---|---|---|---|---|
| Example 4 | 25/11 | TRH/N09 | 1.42–1.47<br>○ | ○ | ○ | 20–25 | 130° C./230° C.<br>○ | ○ |
| Example 5 | 20/17 | TRH/N04 | 1.40–1.45<br>○ | ○ | ○ | 25–30 | 135° C./225° C.<br>○ | ○ |
| Example 6 | 15/4 | TRH/P51 | 1.37–1.42<br>○ | ○ | ○ | 32–37 | 140° C./220° C.<br>○ | ○ |
| Comparative Example 4 | 32/18 | TRH/N09 | 1.47–1.52<br>X | ○ | X | 15–20 | 125° C./240° C.<br>○ | X |
| Comparative Example 5 | 10/13 | TRH/N04 | 1.22–1.32<br>X | X | ○ | 35–40 | 145° C./215° C.<br>○ | X |
| Comparative Example 6 | 20/3 | TRH/P51 | 1.27–1.37 | X | ○ | 30–35 | 135° C./225° C. | X |

TABLE 3

| | Low Toner Consumption Copying (Low Printing Mode) Image Density with Rating | Uniformity in solid shading with the eye | White Spots in solid shading the eye | Toner Fly the eye | Q/M (μc/g) | Offset Resistance at Fixation Offset Occurrence Lower Temp/Higher Temp | General Evaluation |
|---|---|---|---|---|---|---|---|
| Example 7 | 1.40–1.45<br>○ | ○ | ○ | ○ | 20–25 | 130° C./230° C.<br>○ | ○ |
| Example 8 | 1.40–1.43<br>○ | ○ | ○ | ○ | 25–30 | 135° C./225° C.<br>○ | ○ |
| Example 9 | 1.37–1.40<br>○ | ○ | ○ | ○ | 32–37 | 140° C./220° C.<br>○ | ○ |
| Example 10 | 1.37–1.41<br>○ | ○ | ○ | ○ | 22–26 | 130° C./230° C.<br>○ | ○ |
| Example 11 | 1.40–1.44<br>○ | ○ | ○ | ○ | 25–28 | 130° C./230° C.<br>○ | ○ |
| Comparative Example 7 | 1.40–1.45<br>○ | ○ | X | X | 15–20 | 125° C./240° C.<br>○ | X |
| Comparative Example 8 | 1.43–1.45<br>○ | Δ | ○ | X | 16–21 | 130° C./230° C.<br>○ | X |
| Comparative Example 9 | 1.19–1.28<br>X | ○ | Δ | ○ | 35–40 | 145° C./215° C.<br>X | X |
| Comparative Example 10 | 1.25–1.33<br>X | ○ | X | ○ | 30–35 | 135° C./225° C.<br>○ | X |
| Comparative Example 11 | 1.30–1.34<br>X | Δ | ○ | Δ | 27–33 | 130° C./230° C.<br>○ | Δ |
| Comparative Example 12 | 1.25–1.35<br>X | ○ | Δ | Δ | 27–34 | 130° C./230° C.<br>○ | Δ |

TABLE 4

| | Low Toner Consumption Copying (Low Printing Mode) | | | | | Offset Resistance | |
|---|---|---|---|---|---|---|---|
| | Image Density with Rating | Uniformity in solid shading with the eye | White Spots in solid shading the eye | Toner Fly the eye | Q/M (μc/g) | at Fixation Offset Occurrence Lower Temp/Higher Temp | General Evaluation |
| Example 12 | 1.42–1.45 ○ | ○ | ○ | ○ | 20–23 | 130° C./230° C. ○ | ○ |
| Example 13 | 1.41–1.43 ○ | ○ | ○ | ○ | 25–28 | 135° C./225° C. ○ | ○ |
| Example 14 | 1.39–1.40 ○ | ○ | ○ | ○ | 32–34 | 140° C./220° C. ○ | ○ |
| Example 15 | 1.35–1.40 ○ | ○ | ○ | ○ | 24–26 | 130° C./230° C. ○ | ○ |
| Comparative Example 13 | 1.42–1.45 ○ | ○ | Δ | X | 15–28 | 125° C./240° C. ○ | X |
| Comparative Example 14 | 1.43–1.45 ○ | Δ | ○ | X | 16–20 | 130° C./230° C. ○ | X |
| Comparative Example 15 | 1.23–1.28 X | ○ | ○ | ○ | 30–36 | 145° C./215° C. ○ | X |
| Comparative Example 16 | 1.29–1.33 X | ○ | Δ | ○ | 28–33 | 135° C./225° C. ○ | X |

According to the present invention, the electrification characteristics of the chromium complex compound can be sufficiently drawn out while at the same time maintaining the negative electrification property and at-fixation offset-resistant property of the polyester resin itself. The charge donating characteristic of the electric charge controller comprised of the chromium complex compound is not inhibited and the electrification characteristic of the toner is stabilized. Thus, the present invention can provide a toner for developing electrostatic latent images which is free of blushing on the surface of sheets and toner fly at high density, and has an excellent offset resistance, over a long time especially even in high-temperature high-moisture environment.

Further, the toner of the invention, if it also contains the positive charge controller, can provide good copy images without blushing on the surface of sheets, ununiformity in solid shading or toner fly at high density over a long time, also in a toner low-consumption printing mode.

Further, if the polyester resin has a glass transition point of 55 to 66° C., the blocking resistance can be improved.

Furthermore, if the polyester resin has a melt index of 0.1 to 6.0 g/10 min., the offset resistance can be improved.

What is claimed is:

1. A toner for developing electrostatic latent images comprising:

a polyester resin and an electric charge controlling agent containing a chromium complex compound, wherein the polyester resin has an acid value Z of 15 to 30 ($15<Z\leqq 30$) mgKOH/g and a hydroxyl value Y of 4 to 17 ($4\leqq Y\leqq 17$) mgKOH/g.

2. A toner according to claim 1 further comprising a positive charge controlling agent.

3. A toner according to claim 1, wherein the polyester resin has a glass transition point (Tg) of 55 to 65° C.

4. A toner according to claim 1, wherein the polyester resin has a melt index (MI) of 0.1 to 6.0 g/10 minutes.

5. A toner according to claim 1, wherein the chromium complex compound is represented by the formula:

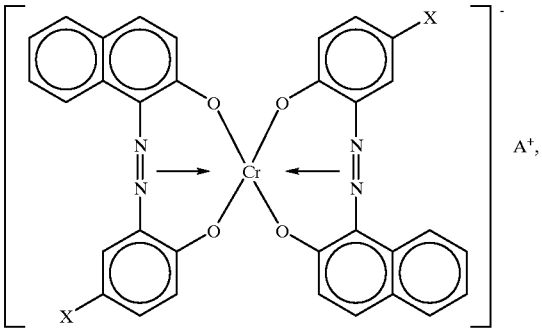

wherein X is Cl, Br, $SO_2NH_2$, $SO_2CH_3$ or $SO_2C_2H_5$, and $A^+$ is a $C_{8-16}$ straight-chain alkylammonium or a $C_{8-16}$ branched alkylammonium in which the alkyl moiety is optionally interrupted by a hetero atom.

6. A toner for developing electrostatic latent images comprising:

a colorant;

a polyester resin;

a negative charge controlling agent containing a chromium complex compound; and a positive charge controlling agent, wherein the polyester resin has an acid value Z of 15 to 30 ($15<Z\leqq 30$) mgKOH/g and a hydroxyl value Y of 4 to 17 ($4\leqq Y\leqq 17$) mgKOH/g, and fluidizing agent particles having a specific surface area of 90 to 240 $m^2/g$ are admixed to the toner in a proportion of 0.1 to 3.0 wt % with respect to the total weight of the toner.

7. A toner according to claim 6, wherein the fluidizing agent particles are silica particles.

8. A toner according to claim 6, wherein the polyester resin has a glass transition point (Tg) of 55 to 65° C.

9. A toner according to claim 6, wherein the polyester resin has a melt index (MI) of 0.1 to 6.0 g/10 minutes.

10. A toner according to claim 6, wherein the chromium complex compound is represented by the formula:

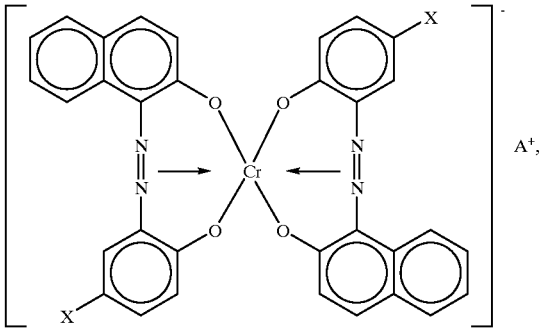

wherein X is Cl, Br, $SO_2NH_2$, $SO_2CH_3$ or $SO_2C_2H_5$, and $A^+$ is a $C_{8-16}$ straight-chain alkylammonium or a $C_{8-16}$ branched alkylammonium in which the alkyl moiety is optionally interrupted by a hetero atom.

11. A toner for developing electrostatic latent images comprising:

a colorant;

a polyester resin;

a negative charge controlling agent containing a chromium complex compound; and a positive charge controlling agent, wherein the polyester resin has an acid value Z of 15 to 30 ($15<Z\leqq 30$) mgKOH/g and a hydroxyl value Y of 4 to 17 ($4\leqq Y\leqq 17$) mgKOH/g, fluidizing agent particles having a specific surface area of 90 to 240 $m^2/g$ are admixed to the toner in a proportion of 0.1 to 5.0 wt % with respect to the total weight of the toner, and positively electrifiable particles having the property of being positively electrified are further admixed to the toner.

12. A toner according to claim 11, wherein the fluidizing agent particles are silica particles and the positively electrifiable particles are inorganic particles of titanium oxide.

13. A toner according to claim 11, wherein the positively electrifiable particles are admixed in a proportion of 0.01 to 2.0 wt % with respect to the total weight of the toner.

14. A toner according to claim 11, wherein the polyester resin has a glass transition point (Tg) of 55 to 65° C.

15. A toner according to claim 11, wherein the polyester resin has a melt index (MI) of 0.1 to 6.0 g/10 minutes.

16. A toner according to claim 11, wherein the chromium complex compound is represented by the formula:

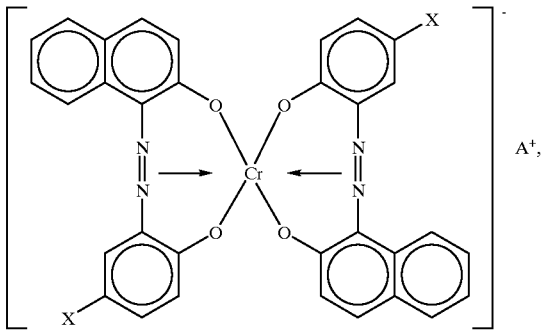

wherein X is Cl, Br, $SO_2NH_2$, $SO_2CH_3$ or $SO_2C_2H_5$, and $A^+$ is a $C_{8-16}$ straight-chain alkylammonium or a $C_{8-16}$ branched alkylammonium in which the alkyl moiety is optionally interrupted by a hetero atom.

17. An image forming apparatus with use of a toner for developing electrostatic latent images as set forth in claim 1.

* * * * *